US010193207B2

(12) United States Patent
Ahn et al.

(10) Patent No.: US 10,193,207 B2
(45) Date of Patent: Jan. 29, 2019

(54) SUBSTRATE FOR SUPPORTING ANTENNA PATTERN AND ANTENNA USING SAME

(71) Applicant: Point Engineering Co., Ltd., Asan-si, Chungcheongnam-do (KR)

(72) Inventors: Bum Mo Ahn, Suwon-si (KR); Seung Ho Park, Hwaseong-si (KR); Tae Hwan Song, Cheonan-si (KR)

(73) Assignee: Point Engineering Co., Ltd., Asan-si, Chungcheongnam-do (KR)

( * ) Notice: Subject to any disclaimer, the term of this patent is extended or adjusted under 35 U.S.C. 154(b) by 44 days.

(21) Appl. No.: 15/511,821

(22) PCT Filed: Aug. 24, 2015

(86) PCT No.: PCT/KR2015/008832
§ 371 (c)(1),
(2) Date: Mar. 16, 2017

(87) PCT Pub. No.: WO2016/047927
PCT Pub. Date: Mar. 31, 2016

(65) Prior Publication Data

US 2017/0294700 A1 Oct. 12, 2017

(30) Foreign Application Priority Data

Sep. 23, 2014 (KR) ..... 10-2014-0126722

(51) Int. Cl.
*H01Q 1/00* (2006.01)
*H01Q 1/38* (2006.01)
(Continued)

(52) U.S. Cl.
CPC ..... *H01Q 1/002* (2013.01); *H01Q 1/38* (2013.01); *H01Q 9/0407* (2013.01); *H01Q 1/526* (2013.01)

(58) Field of Classification Search
CPC ..... H01Q 1/38; H01Q 1/00; H01Q 1/002; H01Q 1/526; H01Q 9/0407; H01Q 13/08
See application file for complete search history.

(56) References Cited

U.S. PATENT DOCUMENTS 6,417,807 B1 * 7/2002 Hsu ..... H01Q 1/38 333/262
6,421,013 B1 * 7/2002 Chung ..... G06K 19/07749 235/441
(Continued)

FOREIGN PATENT DOCUMENTS

JP 2009-090423 A 4/2009 ..... B82B 3/00
KR 10-2010-0023804 A 3/2010 ..... H01L 21/22
(Continued)

OTHER PUBLICATIONS

International Searching Authority, International Search Report—International Application No. PCT/KR2015/008832, dated Dec. 14, 2015, 4 pages.
(Continued)

*Primary Examiner* — Tho G Phan
(74) *Attorney, Agent, or Firm* — Sunstein Kann Murphy & Timbers LLP

(57) ABSTRACT

The present invention relates to a substrate for supporting an antenna pattern. The substrate includes a porous anodic oxide layer having a plurality of pores formed by anodizing metal. A metallic material is filled in at least a part of the pores.

12 Claims, 8 Drawing Sheets

(51) Int. Cl.
*H01Q 9/04* (2006.01)
*H01Q 1/52* (2006.01)

(56) References Cited

U.S. PATENT DOCUMENTS

| | | | | |
|---|---|---|---|---|
| 6,992,436 | B2 * | 1/2006 | Seo | H01L 51/5012 313/504 |
| 8,117,744 | B2 | 2/2012 | Nashner et al. | 29/852 |
| 8,673,258 | B2 * | 3/2014 | Kim | B82Y 30/00 205/78 |
| 9,493,876 | B2 * | 11/2016 | Browning | C23C 28/04 |
| 9,997,837 | B1 * | 6/2018 | Biegelsen | H01Q 9/0407 |
| 2003/0197646 | A1 | 10/2003 | Tran | |
| 2009/0098344 | A1 | 4/2009 | Tomaru | 428/172 |
| 2012/0175782 | A1 | 7/2012 | Im et al. | |
| 2012/0262844 | A1 | 10/2012 | Kim et al. | 361/502 |
| 2017/0288721 | A1 * | 10/2017 | Zhao | C23F 1/36 |

FOREIGN PATENT DOCUMENTS

| | | | | |
|---|---|---|---|---|
| KR | 10-2010-0101885 | A | 9/2010 | H01G 9/032 |
| KR | 10-2011-0082354 | A | 7/2011 | H05K 1/02 |
| KR | 20110082354 | A | 7/2011 | |
| KR | 10-1399835 | | 5/2014 | H04B 1/38 |

OTHER PUBLICATIONS

European Patent Office, Extended European Search Report, Application No. 15844724.3, dated Apr. 6, 2018, 17 pgs.

* cited by examiner

SUBSTRATE FOR SUPPORTING ANTENNA PATTERN AND ANTENNA USING SAME

CROSS REFERENCE

This application is a § 371 application of International Patent Application PCT/KR2015/008832 filed Aug. 24, 2015, which claims priority to Korean Application No. 10-2014-0126722 filed Sep. 23, 2014, the full disclosures of which are hereby incorporated herein by reference.

TECHNICAL FIELD

The present invention relates to a substrate for supporting a patch antenna, and an antenna using the same.

BACKGROUND ART

In general, an antenna is a conversion device for transmitting or receiving an electromagnetic wave of a specific band. The antenna serves to convert an electrical signal of a radio frequency band to an electromagnetic wave or, conversely, serves to convert an electromagnetic wave to an electrical signal. Such an antenna is widely used for a device for receiving radio broadcast, a television broadcast or the like, a radio set using radio waves, a wireless LAN two-way communication device, a radar, a radio wave telescope for space exploration, and so forth. Physically, an antenna is an array of conductors for radiating n electromagnetic field generated when a certain voltage is applied together with a modulated current. A current and a voltage induced in an antenna under the influence of an electromagnetic field are generated between the terminals of the antenna.

A conventional substrate for supporting an antenna pattern has via-holes vertically penetrating the substrate. However, it is difficult to individually process and form such via-holes. Korean Patent No. 10-1399835 discloses a technique on an antenna using a porous aluminum oxide layer. More specifically, the patent cited above discloses a wireless communication device case made of aluminum. The wireless communication device case includes an insulating region having a first porous layer and a second porous layer. The first porous layer includes a first groove formed by anodizing an inner surface of a predetermined region of the case and a first barrier layer as an alumina layer formed around the predetermined region. The second porous layer includes a second groove formed by anodizing an outer surface of the case corresponding to the predetermined region and a second barrier layer as an alumina layer formed around the second groove. The wireless communication device case further includes an antenna pattern formed on the first porous layer and configured to receive radio waves. The first barrier layer and the second barrier make contact with each other in the thickness direction of the case.

However, in the technique of the above-cited patent which utilizes a porous aluminum oxide layer in the field of an antenna, no metallic material is filled in the porous aluminum oxide layer. Thus, the surface area of the porous aluminum oxide layer is small and the impedance thereof is low. In addition, it is required to provide an additional means for cutting off external radio waves introduced from the side surface.

SUMMARY OF THE INVENTION

Technical Problems

The present invention has been made to solve the aforementioned problems inherent in the prior art. It is an object of the present invention to provide a substrate for supporting an antenna pattern, which is capable of being manufactured in an effective manner and capable of minimizing the influence of an external electromagnetic wave while maintaining high impedance, and an antenna using the same.

Solution to Problem

In order to achieve the above object, the present invention provides a substrate for supporting an antenna pattern, wherein the substrate is a porous anodic oxide layer having a plurality of pores formed by anodizing metal, and a metallic material is filled in at least a part of the pores.

In the substrate, the porous anodic oxide layer is a porous aluminum oxide layer formed by anodizing aluminum.

In the substrate, the metallic material is a conductive material. The conductive material includes at least one of a carbon nanotube, graphene, nickel (Ni), silver (Ag), gold (Au), copper (Cu), platinum (Pt), titanium-tungsten alloy (TiW), chromium (Cr) or nickel-chromium alloy (NiCr).

In the substrate, the pores include pores filled with the metallic material and pores not filled with the metallic material. The metallic material is filled in the entirety of the pores or each of the pores is only partially filled with the metallic material. The metallic material filled in the pores is the same material as the antenna pattern.

In the substrate, an average diameter of the pores is 10 nm or more and 300 nm or less and a longitudinal and transverse average distance between the pores is 20 nm or more and 300 nm or less.

According to the present invention, there is provided an antenna, including: a porous anodic oxide layer having a plurality of pores formed by anodizing metal; a metallic material filled in at least a part of the pores; and a metal pattern formed on the porous anodic oxide layer.

According to the present invention, there is provided an antenna, including: a metal base plate; a porous anodic oxide layer having a plurality of pores formed by anodizing a surface of the metal base plate; a metallic material filled in at least a part of the pores; and a metal pattern formed on the porous anodic oxide layer.

In the antenna, the metallic material is filled in the pores positioned below the metal pattern or filled in the pores spaced apart from the metal pattern.

In the antenna, the metal pattern includes a first metal pattern and a second metal pattern formed outside the first metal pattern so as to surround at least a part of the first metal pattern. The first metal pattern is formed in a polygonal shape, a circular shape or an elliptical shape.

In the antenna, the metal base plate is configured to support the porous anodic oxide layer. The metal base plate has an opening portion.

According to the present invention, there is provided an antenna, including: a porous anodic oxide layer having a plurality of pores formed by anodizing metal; a metallic material filled in at least a part of the pores; and a metal pattern formed on the porous anodic oxide layer, wherein an outer surface of the metallic material is exposed below the porous anodic oxide layer. The antenna further includes: a lower metal layer formed on at least a part of a lower portion of the exposed metallic material and a lower portion of the porous anodic oxide layer.

According to the present invention, there is provided an antenna, including: a porous anodic oxide layer having a plurality of pores formed by anodizing a surface of a metal base plate; a metallic material filled in at least a part of the pores; a metal pattern formed on the porous anodic oxide layer; and an insulating material layer formed on at least a portion of the porous anodic oxide layer, on at least a portion of the metal pattern, or on at least a portion of the porous anodic oxide layer and the metal pattern. The porous anodic oxide layer has a thickness of 100 nm or more and 100 μm or less.

In the antenna, the porous anodic oxide layer is a porous aluminum oxide layer.

According to the present invention, there is provided an antenna, including: a porous aluminum oxide layer having a plurality of pores formed by anodizing aluminum; a first metal pattern formed on the porous aluminum oxide layer; a second metal pattern formed so as to surround at least a part of the first metal pattern; a first metallic material filled in the pores positioned below the first metal pattern; and a second metallic material filled in the pores positioned below the second metal pattern.

In the antenna, the first metallic material is the same material as the first metal pattern, and the second metallic material is the same material as the second metal pattern.

According to the present invention, there is provided an antenna, including: a porous aluminum oxide layer having a plurality of pores formed by anodizing aluminum; a metal pattern formed on the porous aluminum oxide layer; and a metallic material filled in the pores positioned outside the metal pattern, so as to surround at least a part of the metal pattern. An average diameter of the pores is 10 nm or more and 300 nm or less and a longitudinal and transverse average distance between the pores is 20 nm or more and 300 nm or less.

According to the present invention, there is provided an antenna, including: a plurality of unit metal patterns each including a first metal pattern and a second metal pattern formed outside the first metal pattern so as to surround at least a part of the first metal pattern; a porous anodic oxide layer configured to support the unit metal patterns; and a metallic material filled in at least a part of pores of the porous anodic oxide layer.

Effects of Invention

According to the substrate of the present invention and the antenna using the same, it is possible to effectively manufacture a substrate for supporting an antenna pattern. By filling a metallic material in the pores of the porous anodic oxide layer, it is possible to minimize the influence of an external electromagnetic wave while maintaining high impedance.

DESCRIPTION OF EMBODIMENTS

Figure 1:
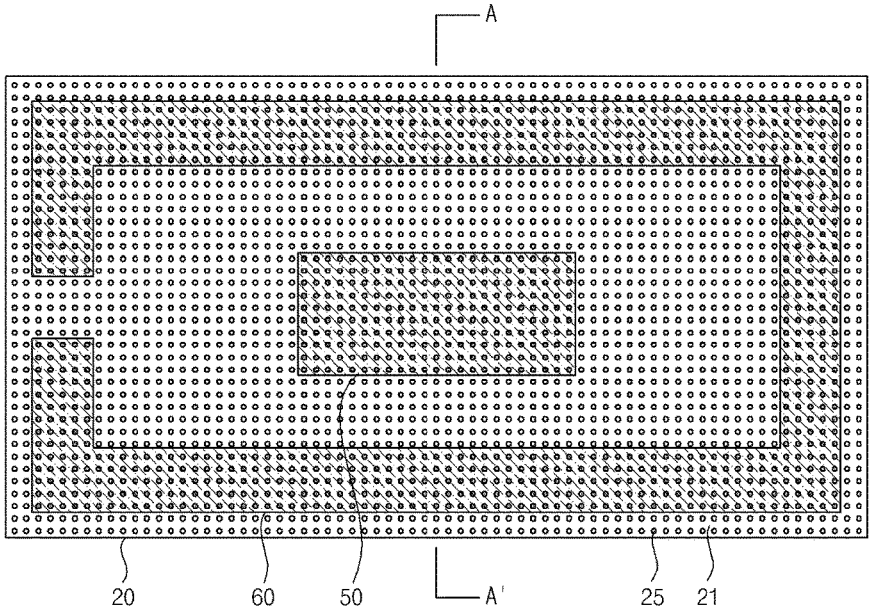
FIG. 1 is a plan view of a substrate for supporting an antenna pattern according to a first embodiment of the present invention and an antenna using the same.

Preferred embodiments of the present invention will now be described in detail with reference to the accompanying drawings. The advantages, features and methods for achieving the same will become apparent from the following description of preferred embodiments given in conjunction with the accompanying drawings. However, the present invention is not limited to the embodiments described herein but may be embodied in many different forms. Rather, the embodiments disclosed herein are provided in order to ensure that the disclosure becomes thorough and perfect and to ensure that the concept of the present invention is sufficiently delivered to a person having an ordinary knowledge in the relevant art. The present invention is defined only by the claims. Throughout the specification, the same reference symbols designate like components.

The terms used herein are presented for the description of the embodiments but are not intended to limit the present invention. In the subject specification, a singular form includes a plural form unless specifically mentioned otherwise. By the term "comprises" or "comprising" used herein, it is meant that a component, a step, an operation or an element referred to herein does not exclude existence or addition of one or more other components, steps, operations or elements. Furthermore, the reference symbols presented in the order of descriptions is not necessarily limited to the specified order. In addition, when saying that a certain film exists on another film or a base plate, it means that a certain film is formed on another film or a base plate either directly or via a third film interposed therebetween. The term "fill" used herein means that something fills an empty space.

The embodiments disclosed herein will be described with reference to sectional views and/or plan views which are ideal exemplary views illustrating the present invention. In the drawings, the thickness of a film and a region is exaggerated to effectively describe the technical contents. Thus, the form of exemplary views may be changed depending on a manufacturing technique and/or a tolerance. For that reason, the embodiments of the present invention are not limited to specific formed illustrated in the drawings but may include changes in form generated depending on a manufacturing process. Accordingly, the regions illustrated in the drawings have general attributes. The shapes of the regions illustrated in the drawings merely illustrate specific forms of element regions and do not limit the scope of the invention.

Preferred embodiments of the present invention will now be described in detail with reference to the accompanying drawings.

When describing different embodiments, for the sake of convenience, components having the same function will be given the same name and the same reference numeral even if the components are included in different embodiments. In addition, for the sake of convenience, the configuration and operation described in one embodiment will be omitted in another embodiment.

First, descriptions will be made on a first embodiment of the present invention.

Figure 2:
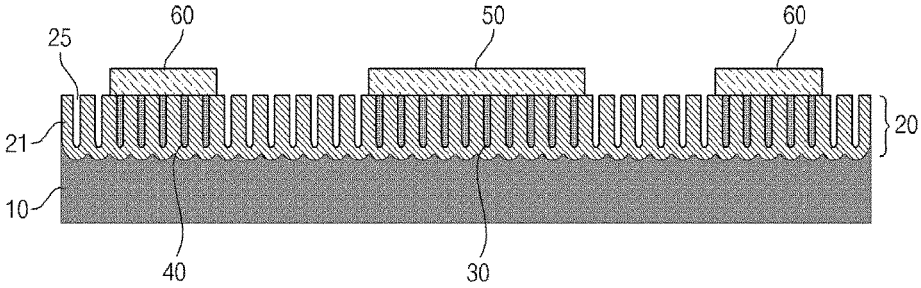
FIG. 2 is a sectional view taken along line A-A' in FIG. 1.

FIG. 1 is a plan view of a substrate for supporting an antenna pattern according to a first embodiment of the present invention and an antenna using the same. FIG. 2 is a sectional view taken along line A-A' in FIG. 1.

A substrate for supporting an antenna pattern according to a first embodiment of the present invention is a porous anodic oxide layer having a plurality of pores formed by anodizing metal. More preferably, the porous anodic oxide layer is a porous anodic aluminum oxide (AAO) layer formed by anodizing a surface of an aluminum base plate 10. A porous anodic aluminum oxide layer 20 is formed using a sulfuric acid, an oxalic acid or the like as an electrolyte. When an electric current is applied to the electrolyte via a rectifier, an oxide layer 21 is first formed. The surface of the oxide layer 21 is made uneven due to the volume expansion of the oxide layer 21. A porous layer is formed as a plurality of pores 25 grows. In the drawings, the diameter, the spacing and the arrangement of the pores are shown on a slightly exaggerated scale for the sake of convenience in description.

The porous anodic oxide layer needs to be formed at a thickness of 100 nm or more in order to form the pores 25 having a predetermined depth. Thus, the thickness of the porous anodic oxide layer is set to 100 nm or more.

If the thickness of the porous aluminum oxide layer 20 exceeds 200 μm, the signal reception sensitivity is reduced and the time required for fully filling the pores with a metallic material to be described later is prolonged. Thus, in the preferred embodiment of the present invention, the thickness of the porous aluminum oxide layer 20 is set to about 200 μm or less.

From the viewpoint of increasing the impedance and minimizing the influence of an external electromagnetic wave, the average diameter of the pores 25 is set to 10 nm or more and 300 nm or less and the longitudinal and transverse average distance between the respective pores is set to 20 nm or more and 300 nm or less.

A first metal pattern 50 is formed on the porous aluminum oxide layer 20. The first metal pattern 50 serves to transmit and/or receive signals. The first metal pattern 50 is formed in a patch form. The first metal pattern 50 may have a rectangular shape. However, the present invention is not limited thereto. The first metal pattern 50 may be formed in a polygonal shape, a circular shape or an elliptical shape.

The material of the first metal pattern 50 includes conductive metal selected from a group consisting of gold (Au), silver (Ag), copper (Cu) and platinum (Pt). Preferably, silver (Ag) may be used as the material of the first metal pattern 50.

The first metal pattern 50 may be formed by a patterning technique in which conductive metal is subjected to electroless plating and then only the region of the first metal pattern 50 is excluded. The fan motor 410 may be formed in an illustrated shape by a masking technique.

In the following descriptions, for the sake of convenience, the pores positioned below the first metal pattern 50 will be referred to as first pores 25*a*. A first metallic material 30 is filled in at least a part of the first pores 25*a* positioned below the first metal pattern 50. The first metallic material 30 is formed in a metal-rod shape. This makes it possible to provide an effect of increasing the surface area and the impedance.

The first metallic material 30 filled in the first pores 25*a* is a conductive material. Preferably, the conductive material may include at least one material selected from a group consisting of a carbon nanotube, graphene, nickel (Ni), silver (Ag), gold (Au), copper (Cu), platinum (Pt), titanium-tungsten alloy (TiW), chromium (Cr) and nickel-chromium alloy (NiCr). The first metallic material 30 may be the same material as the metallic material of the first metal pattern 50.

The first metallic material 30 may be filled in such a way that plural kinds of mutually different metallic materials are laminated one above another. Preferably, nickel (Ni), copper (Cu) and silver (Ag) may be filled by sequentially laminating them. A nickel (Ni) layer filled above the oxide layer 21 serves as a seed layer and enhances the bonding force of the oxide layer 21 with a copper (Cu) layer formed on the nickel (Ni) layer. A copper (Cu) layer filled above the nickel (Ni) layer has high electric conductivity. A silver (Ag) layer is filled above the copper (Cu) layer for the purpose of preventing oxidation.

The pores positioned outside the first metal pattern so as to surround at least a part of the first metal pattern 50 will be referred to as second pores 25*b*. A second metallic material 40 is filled in at least a part of the second pores 25*b*. The second metallic material 40 may be metal similar to or different from the first metallic material 30. The second metallic material 40 may be filled in such a way that plural kinds of mutually different metallic materials are laminated one above another. Preferably, nickel (Ni), copper (Cu) and silver (Ag) may be filled by sequentially laminating them.

The second metallic material 40 is formed in a metal-rod shape. The second metallic material 40 having such a metal-rod shape has an external radio wave blocking function of blocking external radio waves introduced from the side surface of the substrate. This makes it possible to enhance the signal transmission/reception efficiency in the first metal pattern 50.

The first and second metallic materials 30 and 40 filled in the first and second pores 25*a* and 25*b* may be filled in the entirety of the first and second pores 25*a* and 25*b* or may be filled in only a part of the first and second pores 25*a* and 25*b*. In this regard, when saying that the first and second metallic materials 30 and 40 are filled in only a part of the first and second pores 25*a* and 25*b*, it refers to all the cases where a part of each pore is not filled depending on the filling method, for example, a case where a metallic material is filled from an inner wall of each of the pores so that the central portion of each of the pores remains partially empty, a case where a metallic material is filled from a predetermined depth position of each of the pores so that a portion of each of the pores below the predetermined depth position remains empty, and a case where a metallic material is filled from the bottom of each of the pores so that an upper portion of each of the pores remains partially empty.

Figure 3:
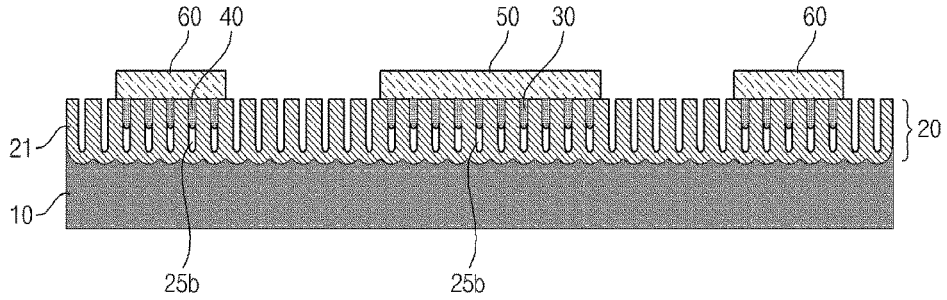
FIG. 3 is a sectional view showing another example of a metallic material according to the first embodiment.

In FIG. 2, there is illustrated an example in which the first and second metallic materials 30 and 40 are filled in the entirety of the first and second pores 25*a* and 25*b*. In FIG. 3, there is illustrated an example in which the first and second metallic materials 30 and 40 are filled in only the upper portions of the first and second pores 25*a* and 25*b*.

A second metal pattern 60 is formed outside the first metal pattern 50 so as to surround at least a part of the first metal pattern 50. The second metal pattern 60 has a function of blocking radio waves which may travel along the surface of the porous aluminum oxide layer 20 and may affect the first metal pattern 50. In the case where the first metal pattern 50 has a rectangular shape as shown in FIG. 1, the second metal pattern 60 is formed in a band-like shape so as to surround the entirety of the first metal pattern 50. A partition of the second metal pattern 60 is opened. In the open portion of the second metal pattern 60, a metal pattern (not shown) electrically connected to the first metal pattern 50 is formed so as to serve as a power supply path leading to the first metal pattern 50.

In the accompanying drawings, there is shown an example in which the second pores 25*b* are positioned below the second metal pattern 60. However, the present invention is not limited thereto. Alternatively, the second pores 25*b* may be formed in a position spaced apart from the second metal pattern 60 and may be filled with the second metallic material 40. The second pores 25*b* and the second metal pattern 60 formed in this way can further enhance the effect of blocking external radio waves.

The first metal pattern 50 and the second metal pattern 60 may be formed either simultaneously or sequentially. In the case where the first metal pattern 50 and the second metal pattern 60 are sequentially formed, the first metal pattern 50 may be first formed and then the second metal pattern 60 may be formed, or vice versa.

Figure 4:
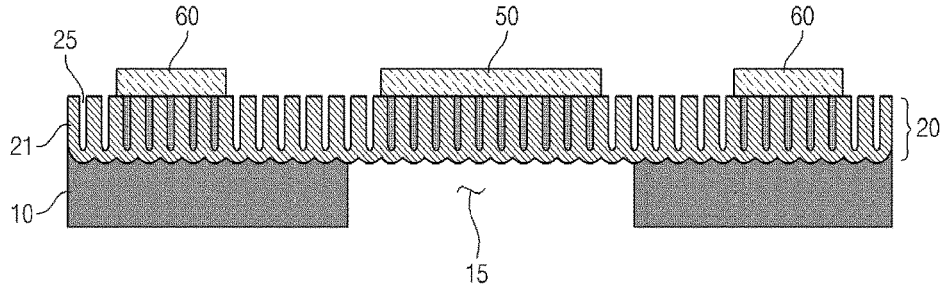
FIG. 4 is a sectional view showing another example of an aluminum base plate according to the first embodiment.

FIG. 4 shows another example of the aluminum base plate 10. The aluminum base plate 10 is configured to support the porous aluminum oxide layer 20 from below. The aluminum base plate 10 may have different forms as long as the slant surfaces 312*a* can achieve a function of supporting the porous aluminum oxide layer 20. As shown in FIG. 4, a portion of the aluminum base plate 10 corresponding to the first metal pattern 50 is removed. Preferably, the aluminum base plate 10 shown in FIG. 4 has a central opening portion 15 having a rectangular portion. With this configuration of the aluminum base plate 10, it is possible to effectively support the porous aluminum oxide layer 20 while allowing signals to be transmitted through the opening portion 15.

Figure 5:
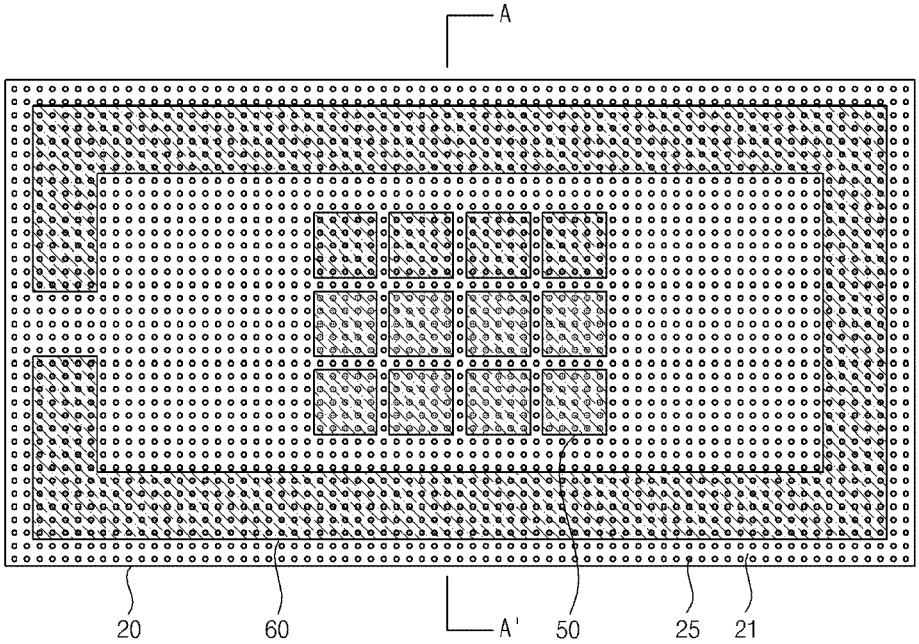
FIG. 5 is a plan view showing another example of a first metal pattern according to the first embodiment.
Figure 6:
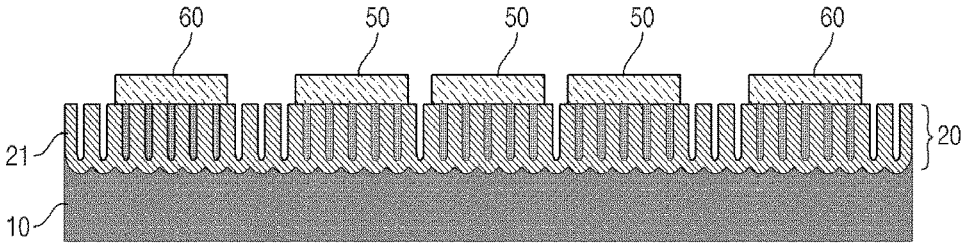
FIG. 6 is a sectional view taken along line A-A' in FIG. 5.

In FIGS. 5 and 6, there is shown another example of the first metal pattern 50. As shown in FIGS. 5 and 6, a plurality of first metal patterns 50 is formed in the same shape. As a further example, unlike those shown in FIGS. 5 and 6, a plurality of first metal patterns 50 may be formed so that at least one of the first metal patterns 50 has a different shape. With the configuration described above, it is possible to provide an antenna corresponding to the frequency band width.

A second embodiment of the present invention will now be described. The following descriptions will be focused on the characteristic components of the second embodiment distinguished from the components of the first embodiment. Descriptions on the components identical with or similar to those of the first embodiment will be omitted.

Figure 7:
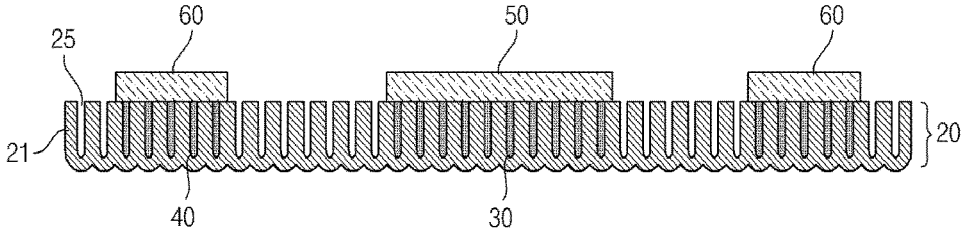
FIG. 7 is a sectional view of a substrate for supporting an antenna pattern according to a second embodiment of the present invention and an antenna using the same.

As shown in FIG. 7, the second embodiment differs from the first embodiment in that the aluminum base plate 10 is removed. Only, the aluminum base plate 10 is removed and the oxide layer 21 as a barrier layer remains as it is. Thus, the lower portions of pores 25 are not penetrated.

A third embodiment of the present invention will now be described. The following descriptions will be focused on the characteristic components of the third embodiment distinguished from the components of the first embodiment. Descriptions on the components identical with or similar to those of the first embodiment will be omitted.

Figure 8:
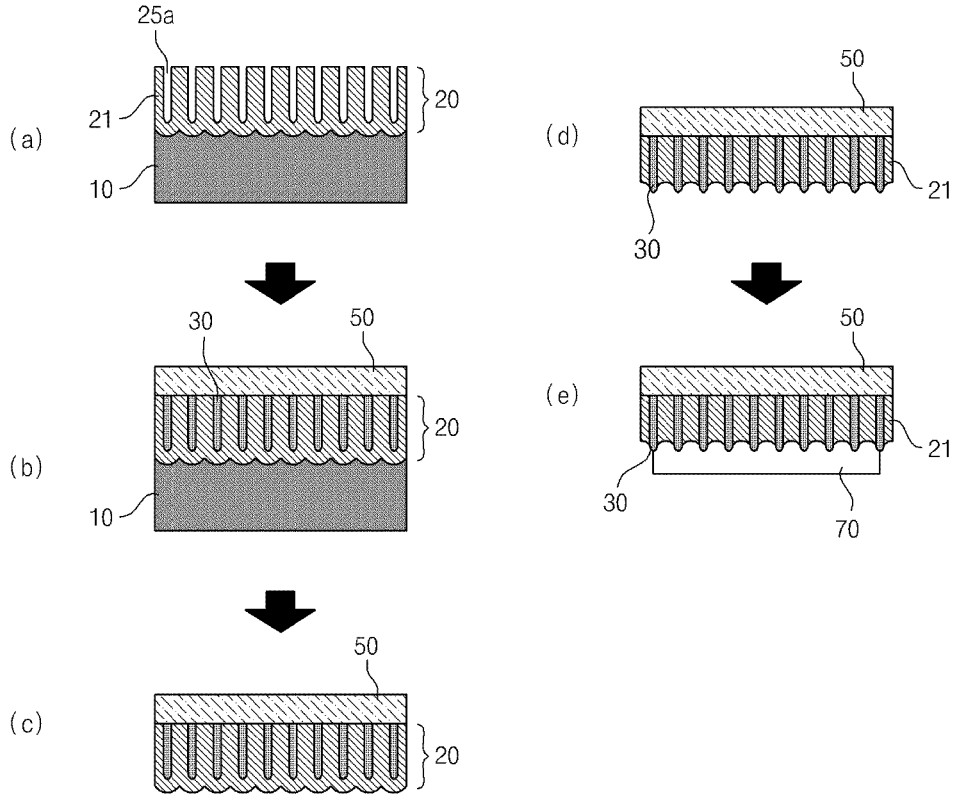
FIGS. 8(*a*) to 8(*e*) are sectional views showing steps of manufacturing a substrate for supporting an antenna pattern according to a third embodiment of the present invention and an antenna using the same.

As shown in FIG. 8(*e*), the substrate according to the third embodiment includes a porous anodic oxide layer having a plurality of pores formed by anodizing metal, a first metal pattern formed above the porous anodic oxide layer, and a metallic material filled in the pores positioned below the first metal pattern so that the outer surfaces thereof are exposed below the porous anodic oxide layer. The substrate according to the third embodiment further includes a lower metal layer formed below at least a part of the exposed metallic material and the porous anodic oxide layer. With the configuration described above, the first metal pattern 50 becomes a thin-film-type bidirectional antenna capable of transmitting and receiving signals in the vertical direction on the basis of the drawings.

A process of manufacturing the substrate according to the third embodiment will now be described.

As shown in FIG. 8(*a*), a porous anodic oxide layer having a plurality of pores is formed by anodizing metal. Preferably, the porous anodic oxide layer is a porous aluminum oxide layer 20 formed by anodizing the surface of an aluminum base plate 10.

As shown in FIG. 8(*b*), a first metal pattern 50 is formed on the porous aluminum oxide layer 20. A first metallic material 30 is filled in the pores 25*a* positioned below the first metal pattern 50.

As shown in FIG. 8(*c*), the aluminum base plate 10 is removed. In this case, only the aluminum base plate 10 is selectively removed while leaving the porous aluminum oxide layer 20 as it is.

As shown in FIG. 8(*d*), the lower portion of the oxide layer 21 is partially removed so that the outer surface of the first metallic material 30 is exposed below the porous aluminum oxide layer 20.

As shown in FIG. 8(*e*), a lower metal layer 70 is formed below the exposed first metallic material 30 and the porous aluminum oxide layer 20.

Thus, the first metallic material 30 exposed below the porous aluminum oxide layer 20 may serve as a power supply path leading to the first metal pattern 50. In the case where the lower metal layer 70 is additionally formed, it may be possible to realize a bidirectional antenna.

In the example shown in FIGS. 8(*a*) to 8(*e*), the outer surface of the first metallic material 30 is exposed below the porous aluminum oxide layer 20. In addition, the outer surface of a second metallic material 40 may be exposed below the porous aluminum oxide layer 20.

A fourth embodiment of the present invention will now be described. The following descriptions will be focused on the characteristic components of the fourth embodiment distinguished from the components of the first embodiment. Descriptions on the components identical with or similar to those of the first embodiment will be omitted.

Figure 9:
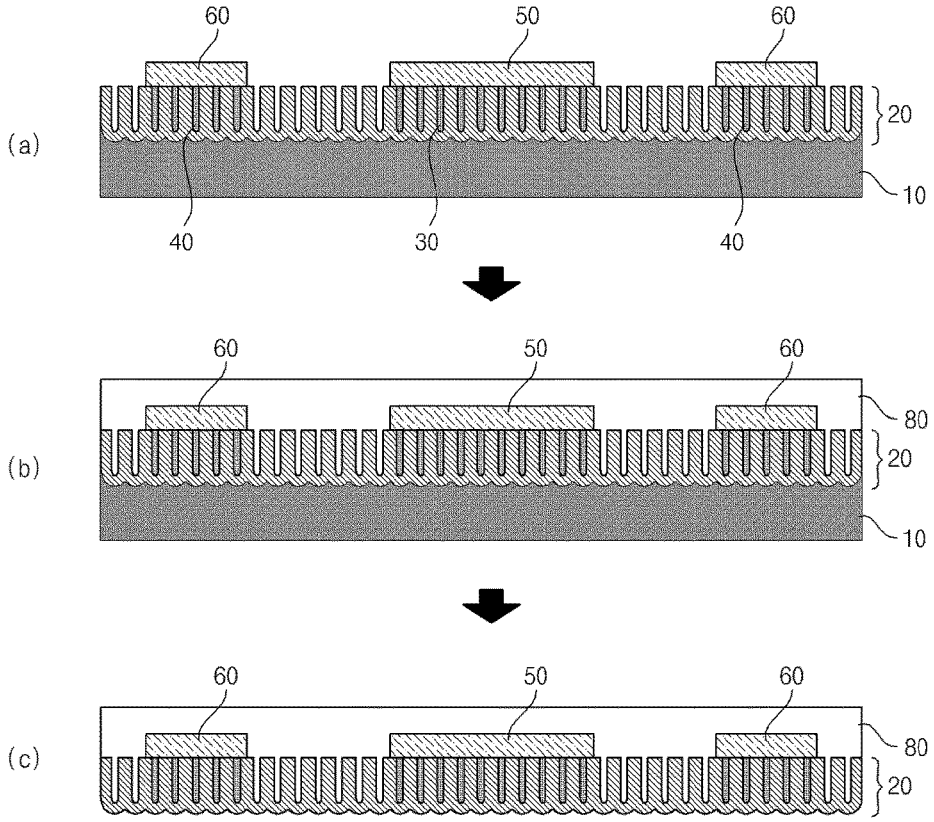
FIGS. 9(*a*) to 9(*c*) are sectional views showing steps of manufacturing a substrate for supporting an antenna pattern according to a fourth embodiment of the present invention and an antenna using the same.

As shown in FIGS. 9(*a*) to 9(*c*), the substrate according to the fourth embodiment includes a porous anodic oxide layer having a plurality of pores formed by anodizing metal, a metallic material filled in at least a part of the pores, a first metal pattern formed on the porous anodic oxide layer, and an insulating material layer formed on the porous anodic oxide layer and the first metal pattern. With the configuration described above, it is possible to effectively reduce the thickness of the porous anodic oxide layer and to prevent an electric field from being leaked along the surface of the porous anodic oxide layer.

A process of manufacturing the substrate according to the fourth embodiment will now be schematically described.

As shown in FIG. 9(*a*), a porous anodic oxide layer having a plurality of pores is formed by anodizing metal. Preferably, the porous anodic oxide layer is a porous aluminum oxide layer 20 formed by anodizing the surface of an aluminum base plate 10. A first metal pattern 50 is formed on the porous aluminum oxide layer 20. A first metallic material 30 is filled in the first pores 25*a* positioned below the first metal pattern 50. A second metal pattern 60 is formed in a position spaced apart from the first metal pattern 50. A second metallic material 40 is filled in the second pores 25*b* positioned below the second metal pattern 60.

As shown in FIG. 9(*b*), an insulating material layer 80 is formed on the structure shown in FIG. 9(*a*). The insulating material layer 80 is formed on at least a portion of the porous aluminum oxide layer 20, on at least some portions of the first and second metal patterns 50 and 60, or on at least some portions of the porous aluminum oxide layer 20 and the first and second metal patterns 50 and 60. With this configuration, even when the thickness of the porous aluminum oxide layer 20 is set to 100 nm or more and 100 μm or less, the strength of the porous aluminum oxide layer 20 is reinforced by the insulating material layer 80. It is therefore possible to prevent breakage of the porous aluminum oxide layer 20.

As shown in FIG. 9(*c*), the aluminum base plate 10 is removed. While the entirety of the aluminum base plate 10 is removed in FIG. 9(*c*), the present invention is not limited thereto. As shown in FIG. 4, the aluminum base plate 10 may be partially removed.

This makes it possible to effectively reduce the thickness of the porous aluminum oxide layer 20. It is also possible to effectively prevent an electric field from being leaked along the surface of the porous aluminum oxide layer 20.

A fifth embodiment of the present invention will now be described. The following descriptions will be focused on the characteristic components of the fifth embodiment distinguished from the components of the first to fourth embodiments. Descriptions on the components identical with or similar to those of the first to fourth embodiments will be omitted.

The substrate according to the fifth embodiment of the present invention includes: a plurality of unit metal patterns each including a first metal pattern above-described a second metal pattern formed outside the first metal pattern so as to surround at least a portion of the first metal pattern; a porous anodic oxide layer configured to support the unit metal patterns; and a metallic material filled in at least some of pores of the porous anodic oxide layer.

Figure 10:
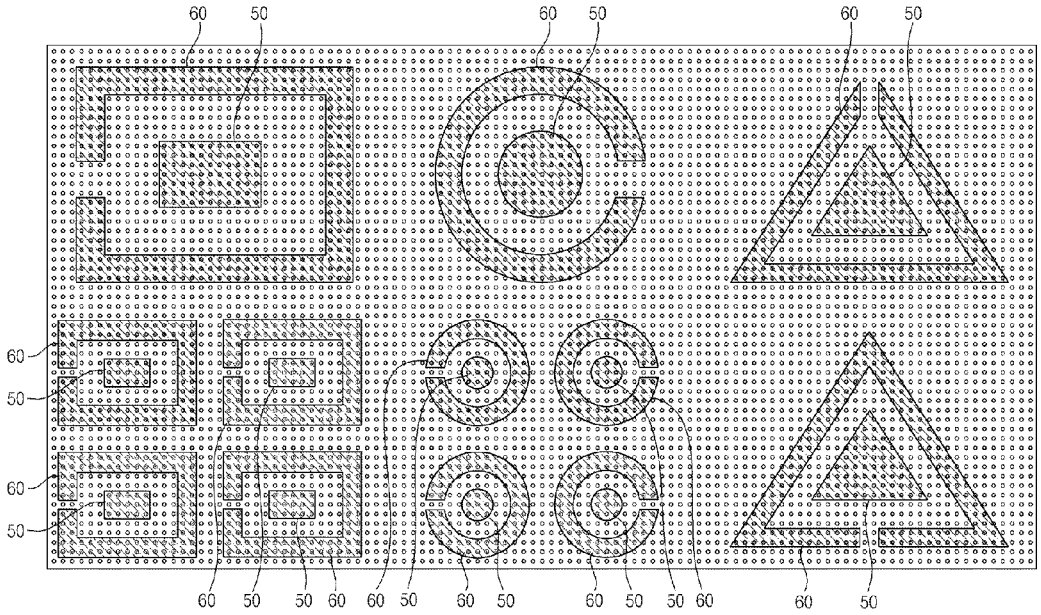
FIG. 10 is a plan view of a substrate for supporting an antenna pattern according to a fifth embodiment of the present invention and an antenna using the same.

As shown in FIG. 10, a plurality of unit antenna patterns each including first and second metal patterns 50 and 60 is formed on the same plane. The technical idea of the present invention according to the fifth embodiment is not limited to the shape of components and the number of components shown in FIG. 10. By forming the plurality of unit antenna patterns as described above, it is possible to effectively provide an antenna corresponding to different frequency band widths.

While preferred embodiments of the present invention have been described above, the present invention is not limited to the aforementioned embodiments. It goes without saying that a person skilled in the relevant art can make various changes and modifications without departing from the spirit and scope of the invention defined in the claims.

INDUSTRIAL APPLICABILITY

The substrate for supporting a patch antenna according to the present invention and the antenna using the same are particularly suitable for use in digital devices such as a smartphone and the like.

DESCRIPTION OF REFERENCE NUMERALS

10: aluminum base plate
15: opening portion
20: porous aluminum oxide layer
21: oxide layer
25: pores
30: first metallic material
40: second metallic material
50: first metal pattern
60: second metal pattern
70: lower metal layer
80: insulating material layer

The invention claimed is:

1. A substrate for supporting an antenna pattern, comprising:
a porous anodic oxide layer having a plurality of pores formed by anodizing metal;
a first metal pattern formed on the porous anodic oxide layer; and
a second metal pattern formed so as to surround at least a part of the first metal pattern;
wherein metallic materials are filled in the pores positioned below the first and second metal patterns.

2. The substrate of claim 1, wherein the porous anodic oxide layer is a porous aluminum oxide layer formed by anodizing aluminum.

3. The substrate of claim 1, wherein the metallic material includes at least one of a carbon nanotube, graphene, nickel (Ni), silver (Ag), gold (Au), copper (Cu), platinum (Pt), titanium-tungsten alloy (TiW), chromium (Cr) and nickel-chromium alloy (NiCr).

4. The substrate of claim 1, wherein each of the pores is only partially filled with the metallic material.

5. An antenna, comprising:
a porous anodic oxide layer having a plurality of pores formed by anodizing metal;
a first metal pattern formed on the porous anodic oxide layer;
a second metal pattern formed so as to surround at least a part of the first metal pattern;
wherein metallic materials are filled in the pores positioned below the first and second metal patterns.

6. The antenna of claim 5, further comprising a metal base plate,
wherein the metal base plate is anodized to form the plurality of pores.

7. The antenna of claim 6, wherein the metal base plate has an opening portion.

8. The antenna of claim 5, further comprising:
an insulating material layer formed on at least a portion of the porous anodic oxide layer, on at least a portion of the first and second metal patterns, or on at least a portion of the porous anodic oxide layer and the first and second metal patterns.

9. The antenna of claim 5, wherein an outer surface of the metallic material is exposed below the porous anodic oxide layer.

10. The antenna of claim 9, further comprising:
a lower metal layer formed on at least a part of a lower portion of the porous anodic oxide layer.

11. The antenna of claim 5, wherein the porous anodic oxide layer comprises aluminum oxide.

12. An antenna, comprising:
a porous aluminum oxide layer having a plurality of pores formed by anodizing aluminum;
a first metal pattern formed on the porous aluminum oxide layer;
a second metal pattern formed so as to surround at least a part of the first metal pattern;
a first metallic material filled in the pores positioned below the first metal pattern; and a second metallic material filled in the pores positioned below the second metal pattern;

wherein metallic materials are filled in the pores positioned below the first and second metal patterns.

* * * * *